US005400208A

United States Patent [19]

Pazda et al.

[11] Patent Number: 5,400,208

[45] Date of Patent: Mar. 21, 1995

[54] WEB EDGE DISCHARGING SYSTEM

[75] Inventors: Robert J. Pazda, Waterloo; Kenneth L. Clum, Webster, both of N.Y.

[73] Assignee: Eastman Kodak Company, Rochester, N.Y.

[21] Appl. No.: 132,144

[22] Filed: Oct. 5, 1993

Related U.S. Application Data

[63] Continuation of Ser. No. 633,881, Dec. 26, 1990, abandoned.

[51] Int. Cl.[6] ..... H05F 3/02

[52] U.S. Cl. ..... 361/221; 271/208; 361/212; 361/214

[58] Field of Search ..... 361/212, 214, 220, 221; 271/208

[56] References Cited

U.S. PATENT DOCUMENTS

| | | | |
|---|---|---|---|
| 3,268,766 | 8/1966 | Amos | 361/212 |
| 3,533,692 | 10/1970 | Blanchette et al. | 355/16 |
| 3,620,614 | 11/1971 | Gunto et al. | 355/219 |
| 3,636,408 | 1/1972 | Shuman | 361/221 |
| 3,744,898 | 7/1973 | Kurahashi et al. | 355/224 |
| 3,757,163 | 9/1973 | Gibbons et al. | 361/221 |
| 3,757,164 | 9/1973 | Binkowski | 361/212 |
| 3,851,842 | 12/1974 | Bastiaans | 242/199 |
| 3,921,037 | 11/1975 | Testone | 361/212 |
| 4,363,070 | 12/1982 | Kisler | 361/212 |
| 4,414,260 | 11/1983 | Rzepecki et al. | 428/212 |
| 4,512,653 | 4/1985 | Ng et al. | 355/16 |
| 4,553,191 | 11/1985 | Franks, Jr. et al. | 361/212 |
| 4,555,171 | 11/1985 | Clouthier | 361/225 |
| 4,860,159 | 8/1989 | Rodrigo | 361/212 |
| 5,319,516 | 6/1994 | Perkins | 361/220 |

FOREIGN PATENT DOCUMENTS

| | | | |
|---|---|---|---|
| 359462 | 3/1990 | European Pat. Off. . | |
| 2206650 | 6/1974 | France . | |
| 2301313 | 8/1973 | Germany . | |
| 3230667 | 2/1984 | Germany | 361/214 |
| 450020 | 7/1950 | Italy | 361/212 |
| 1344908 | 1/1974 | United Kingdom . | |
| 1061296 | 12/1983 | U.S.S.R. | 361/214 |
| 79/00603 | 8/1979 | WIPO . | |

OTHER PUBLICATIONS

Andrews, Mandravelis, and Mills, "Controlling Polar Charge With Low Electrical Potentials," Research Disclosure No. 190, p. 70, dated Feb. 1980.

*Primary Examiner*—A. D. Pellinen
*Assistant Examiner*—Richard T. Elms
*Attorney, Agent, or Firm*—Carl F. Ruoff

[57] ABSTRACT

Static charge on a charge retaining, somewhat conductive moving web is reduced by a non-contacting apparatus placed at the edge of and coplanar with the moving web. The apparatus is comprised of metallic needles or bristles, a conductive support or other conductive material connecting the needles or bristles in parallel, and an electrical ground connected to the support by an electrical coupling means, which together make up a conductive path for static charges to be removed from the moving web to ground.

19 Claims, 1 Drawing Sheet

WEB EDGE DISCHARGING SYSTEM

This is a continuation of application Ser. No. 07/633,881, filed Dec. 26, 1990, now abandoned.

FIELD OF THE INVENTION

This invention relates to a system for removing static electrical charges from a charge retaining moving web.

BACKGROUND OF THE INVENTION

In processing charge retaining webs, static electric charges tend to build up on the web. Typically, such webs have layers of somewhat conductive material (i.e. material having a surface resistivity of up to $1\times10^{12}$ ohms, more particularly $1\times10^{7}$ to $1\times10^{12}$ ohms, measured between parallel edges of a square piece of that material regardless of size). During processing, these webs are charged by frictional contact with stationary guide surfaces in the web handling apparatus or by roller contact electrification. Such static charge build-up is found, for example, in webs of photographic products, such as photographic paper or film.

The build-up of static charge can result in a variety of serious problems. One problem caused by such charge is that the web material is attracted to itself or to handling apparatus. As a result, the operating efficiency of the apparatus is diminished. In addition, the presence of static charge attracts dust to the web surface and produces electrical discharges which can shock operators and cause undesirable exposure of photosensitive materials.

Static electric charges, present in and on sheets or webs, have been dissipated in a variety of ways.

In U.S. Pat. No. 3,757,164 to Binkowski, brush-like attachments are placed across a sheet or web in a contacting relationship to conduct charges to ground. Such contact can, however, scratch, mar, and wear down the sheet or web. Even if this device is used as a non-contacting, inductive neutralizer, the web is likely to be damaged by brush bristles which break off and fall onto the web. These brush filaments carried by the web can also interfere with the operation of web handling equipment.

In U.S. Pat. No. 3,533,692 to Blanchette et al. ("Blanchette"), an edge contacting device is utilized to maintain a photoconductive web at a desired potential. Such contact is, however, undesirable, because the web edge may be fragile.

Other devices use a power source to generate ions in an electric field capable of neutralizing static electrical charges. These devices may utilize direct current power sources, as in Blanchette, or corona discharge devices, as in U.S. Pat. No. 3,620,614 to Gunto et al., or alternating current power sources, as in U.S. Pat. No. 4,363,070 to Kisler. However, these devices are expensive to purchase and operate and are difficult to install compared with devices using no external power source.

Non-contacting devices have also been used to remove electric charges from a moving web. U.S. Pat. No. 3,268,766 to Amos discloses a device utilizing a system which forces air through a stationary guide in the web handling apparatus to provide a blanket of air between the web and a porous conductive surface. The guide is connected to a ground attachment, providing a path for discharge of the electrostatic charges. Unfortunately, this apparatus requires a source of compressed air which, again, increases installation and maintenance costs of the device and makes it less versatile relative to placement in the device.

SUMMARY OF THE INVENTION

It has been found that the static charges on webs redistribute laterally and become highly concentrated at the edges of the web. This lateral redistribution, due to the repulsion of like charges, results in a higher charge density at the outer edges of the web relative to the center. The present invention utilizes this redistribution phenomenon to reduce static charge effectively. The present invention provides an apparatus and method for removing static electrical charges from a charge retaining, moving web.

Briefly described, the present invention is a method and apparatus placed at the edge of a moving web that reduces static electrical charges present on the web. The apparatus, comprising elongate conductive members (preferably metallic needles or bristles), an electrical ground, and an electrical conductor coupling the conductive members to the ground. This apparatus, together with ions between the conductive members and the web, provide a conductive path to ground for static charges that accumulate at the edge of the moving web.

This static discharge technique represents a substantial improvement over the prior art. The apparatus does not contact the web and requires no external power source. Further, the conductive needles or bristles can be advantageously placed so that they are not above the web. This prevents conductive elements from falling onto the moving web and damaging it or creating problems elsewhere in the web-handling apparatus. For example, the conductive members can be coplanar to the web and positioned outside the web's edge.

This apparatus is inexpensive to manufacture, install, and operate. The device is versatile, because it will remove charges of either polarity and will remove charge from a charge retaining web sharing a layer of somewhat conductive material regardless of whether the layer is an external or internal portion of the web. Further, there is virtually no limitation on its placement in any web handling apparatus.

DETAILED DESCRIPTION OF THE DRAWINGS

Figure 1:
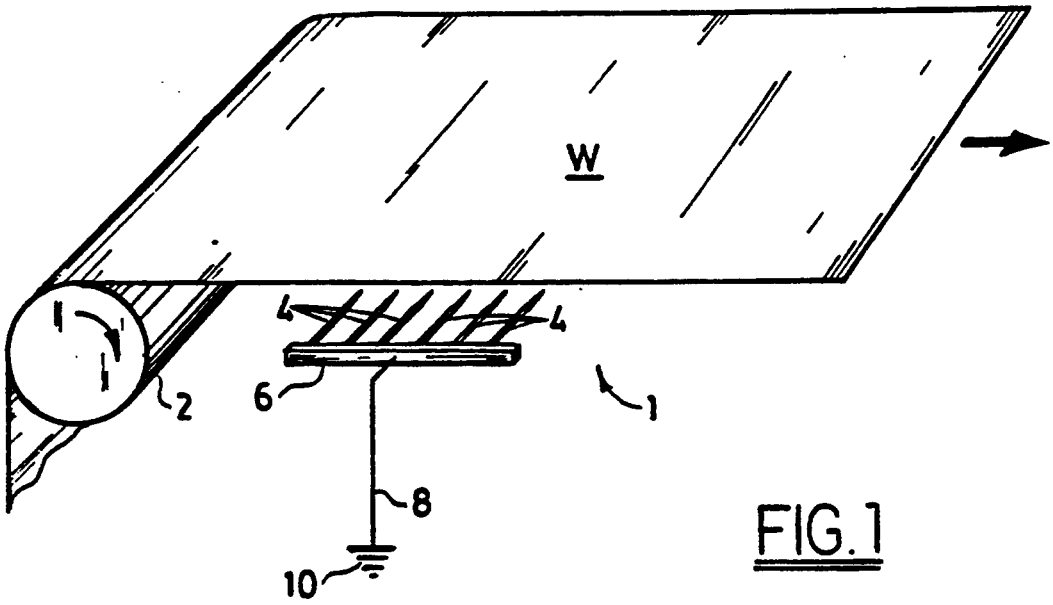
FIG. 1 is a perspective view of one embodiment of the static discharge device of the present invention positioned at the edge of a charge retaining moving web.

FIG. 1 is a perspective view of one embodiment of the static discharge device of the present invention positioned at the edge of a charge retaining moving web W having conductive layer C. Static discharge apparatus 1 includes a number of parallel, coplanar conductive needles 4. Needles 4 are linked by conductive support means 6 which is in turn coupled by electrical conductor 8 to ground attachment 10. The distal ends of needles 4 extend toward, but do not touch, the edge of web W.

Figure 2:
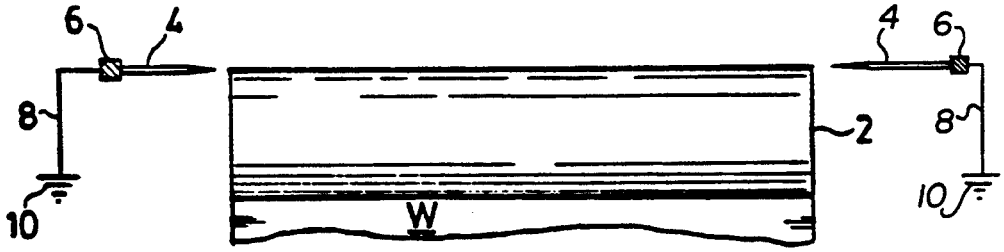
FIG. 2 is a perspective view of an embodiment of the static discharge device of the present invention positioned at each edge of a charge retaining moving web.

As shown in FIG. 2, which is a perspective view of an embodiment of the static discharge device of the present invention positioned at each edge of a charge retaining moving web, needles 4 are coplanar to and at the edge of moving web W. The distal ends of the needles 4 are proximate to, but do not touch, web W. Although the distance between the distal ends of the needles 4 and web W may be varied from 0.05 to 5.0 cm, a distance of 0.5 cm is preferred.

Figure 3:
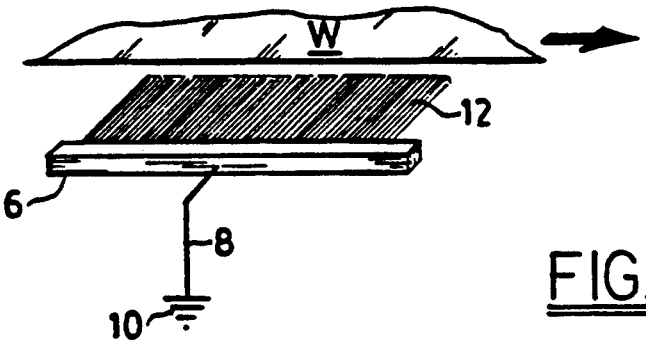
FIG. 3 is a perspective view of an alternative embodiment of the present invention.

The conductive members may be a plurality of spaced, needle-like members 4, as shown in FIG. 1, or a plurality of thinner, closely-aligned metallic bristles 12, as shown in FIG. 3. Needles 4 and bristles 12 may be made from any of a variety of durable, conductive materials. Tungsten steel or stainless steel are particularly preferred.

As mentioned above, the distance of the needles 4 from the edge of web W may be varied, as may be the linear density and overall linear length of the needles 4 or bristles 12, depending on the amount of static charge that must be removed from the web. Other variables affecting the performance of the present invention are the conductivity and velocity of the web.

The invention removes static electrical charge in the following manner. Referring to FIG. 1, charge retaining web W is moved through a web handling apparatus over roller 2 and passes by static discharge apparatus 1. The charge on moving web W accumulates at the web edge, and, as a result, a high electric field exists between the edge of moving web W and needles 4. When the electric field between web W and needles 4 is high enough, air ionization occurs at the tips of needles 4 resulting in the induction discharging of web W at its edge. The needles 4, conductive support means 6, and the electrical coupling 8 provide a current path to ground 10.

This process is iterative. As static charge is removed from the web edge, the charge remaining on the web redistributes to the edge. This again creates an electric field strong enough to ionize the air at the needle tips and the process continues as previously described. Consequently, more static charge is removed by needles 4, conductive support means 6, coupling 8, and ground 10 until the level of charge on the edge of web W is below the threshold needed to ionize the air between the edge and needles 4. The system will remove charges of either polarity, dependent only on a requisite charge density.

Although the present invention will not reduce the average charge density of the web to zero, it will reduce the charge density to a level sufficient to avoid many of the manufacturing and handling problems associated with static electrification.

The following example is illustrative.

EXAMPLE

A 35 mm web of photographic film having a surface resistivity of $1.5\times10^{11}$ ohms charged to a density of 2.6 microcoulombs per square meter ("$\mu C/m^2$") was transported over a series of supporting rollers at a velocity of 1.0 m/sec. When passed by the present invention as embodied in FIG. 1, using tungsten steel needles, at a distance of 1.0 cm from the distal ends of the apparatus, the charge density on the moving web was reduced to 1.3 $\mu C/m^2$. The length of the needle array was 8.4 cm with a center to center distance between needles of 0.76 cm. When the same film was charged to a density of 3.3 $\mu C/m^2$ this apparatus likewise reduced the charge density to 1.3 $\mu C/m^2$.

Although the invention has been described in detail, for the purpose of illustration, it is understood that such detail is for that purpose and variations can be made therein by those skilled in the art without departing from the spirit and scope of the invention which is defined by the following claims.

We claim:

1. A method of reducing static electrical charge on a charge retaining web comprising the steps of:

moving the web, having a pair of edges along a path of travel, whereby the web accumulates static electrical charges and reducing static electrical charge on the web by:

placing a plurality of elongate conductive members proximate to one or both edges of said web but not extending transversely across said web said elongate conductive members positioned substantially coplanar with said moving web wherein ends of said members extend toward said edge or edges of said web; and electrically coupling said conductive members and an electrical ground attachment, wherein said conductive members, said electrical ground attachment, and an electrical conductor provide a path for removal of static electrical charges from said web to said ground.

2. The method of claim 1, wherein said conductive members do not contact said moving web.

3. The method of claim 1, wherein said conductive members are spaced from the edge of said moving web by a distance of 0.05 to 5.0 cm.

4. The method of claim 3, wherein said conductive members are spaced from the edge of said moving web by a distance of 0.5 cm.

5. The method of claim 1, wherein said conductive members are positioned proximate to only one edge of said web.

6. The method of claim 1, wherein said conductive members are positioned proximate to both edges of said web.

7. The method of claim 1, wherein said web exhibits a surface resistivity between $1\times10^{7}$ and $1\times10^{12}$ ohms.

8. The method of claim 1, wherein said discharge system further comprises:

a conductive support means connecting said conductive members all in a parallel, coplanar relationship.

9. The method of claim 1, wherein said conductive members are composed of material selected from the group consisting of tungsten steel and stainless steel.

10. The method of claim 1, wherein said conductive members are closely adjacent bristles.

11. The method of claim 1, wherein said conductive members are equidistantly spaced conductive needles.

12. The method of claim 1, wherein said web has a layer of somewhat conductive material that is either an interior or exterior layer of said web.

13. The method of claim 1, wherein said static electrical charges are of either positive or negative polarity.

14. An apparatus for reducing static electrical charge on a charge retaining web comprising:

means to move the charge retaining web along a path of travel, the charge retaining web having a pair of edges;

a plurality of elongate, conductive members wherein ends of said conductive members extend toward and are located proximate to one or both edges of said web but not extending transversely across said web and positioned outside both edges of said web, said elongate conductive members positioned substantially coplanar with said web;

an electrical ground attachment; and an electrical conductor coupling said conductive members and said electrical ground attachment, wherein said conductive members, said electrical ground attachment, and said electrical conductor provide a path for removal of static electrical charge from said web to ground.

15. An apparatus according to claim 14, wherein said conductive members are equidistantly spaced needles.

16. An apparatus according to claim 14, wherein said conductive members are composed of material selected from the group consisting of tungsten steel and stainless steel.

17. An apparatus according to claim 14, wherein said conductive members are closely adjacent bristles.

18. An apparatus according to claim 14, further comprising:

support a conductive support means connecting said conductive members all in a parallel, coplanar relationship.

19. A method of removing static electrical charges from a charge retaining web containing a layer of somewhat conductive material comprising the steps of: moving the web, having a pair of edges, along a path of travel and removing static electrical charges from the web by:

placing a plurality of elongate, conductive members proximate to one or both edges of said web but not extending transversely across said web and wherein said members are parallel to and coplanar with said web;

connecting said conductive members all in a parallel, coplanar relationship with a conductive support means; and coupling said connected conductive members and an electrical ground attachment with an electrical conductor, wherein said conductive members, said support means, said electrical ground attachment, and said electrical conductor provide a path for removal of static electrical charges from web to ground.

* * * * *